US009187298B2

(12) United States Patent
DeSoo et al.

(10) Patent No.: US 9,187,298 B2
(45) Date of Patent: Nov. 17, 2015

(54) EQUALIZING RIGGING BLOCK FOR USE WITH A SYNTHETIC ROUNDSLING

(71) Applicant: Slingmax, Inc., Aston, PA (US)

(72) Inventors: Tom DeSoo, Aston, PA (US); Brett Woodland, Wilmington, CA (US)

(73) Assignee: SLINGMAX, INC., Aston, PA (US)

( * ) Notice: Subject to any disclaimer, the term of this patent is extended or adjusted under 35 U.S.C. 154(b) by 124 days.

(21) Appl. No.: 13/828,449

(22) Filed: Mar. 14, 2013

(65) Prior Publication Data

US 2014/0264214 A1 Sep. 18, 2014

(51) Int. Cl.
*B66D 3/04* (2006.01)

(52) U.S. Cl.
CPC ..... *B66D 3/04* (2013.01)

(58) Field of Classification Search
CPC .... B66D 3/04; B66D 2700/028; F16C 13/006
USPC ..... 254/390, 393, 401, 403–404, 412, 416
See application file for complete search history.

(56) References Cited

U.S. PATENT DOCUMENTS

| | | | | | |
|---|---|---|---|---|---|
| 386,826 | A * | 7/1888 | Howard | 254/417 |
| 817,074 | A * | 4/1906 | La Rose | 384/547 |
| 1,399,326 | A * | 12/1921 | Taylor | 254/390 |
| 1,574,799 | A * | 3/1926 | Dierks | 384/588 |
| 1,629,690 | A * | 5/1927 | Fentress | 384/588 |
| 1,634,773 | A * | 7/1927 | Coventry | 254/411 |
| 1,769,411 | A * | 7/1930 | Bennett | 254/404 |
| 2,052,075 | A * | 8/1936 | Black | 254/404 |
| 2,672,320 | A * | 3/1954 | Minor | 254/404 |
| 3,528,645 | A * | 9/1970 | Harken | 254/412 |
| 3,804,372 | A * | 4/1974 | Fuchs | 254/417 |
| 5,449,154 | A * | 9/1995 | Lob | 254/394 |
| 5,511,447 | A * | 4/1996 | Galloway et al. | 74/577 S |
| 5,538,224 | A * | 7/1996 | Powell et al. | 254/406 |
| 5,561,973 | A | 10/1996 | St. Germain | |
| 5,651,572 | A | 7/1997 | St. Germain | |
| 5,651,573 | A | 7/1997 | St. Germain | |
| 6,305,669 | B1 * | 10/2001 | Harken et al. | 254/412 |
| 6,684,805 | B2 * | 2/2004 | Curchod | 114/218 |
| 7,419,138 | B1 * | 9/2008 | Mauthner | 254/394 |
| 7,438,281 | B2 * | 10/2008 | Pesnel | 254/393 |
| 7,562,862 | B1 * | 7/2009 | Jackson | 254/376 |
| 7,568,333 | B2 | 8/2009 | St. Germain | |
| 7,594,642 | B2 * | 9/2009 | Curchod | 254/390 |
| 7,661,737 | B2 | 2/2010 | St. Germain | |
| 7,744,138 | B2 | 6/2010 | St. Germain | |
| 7,926,859 | B2 | 4/2011 | St. Germain | |
| 7,988,132 | B2 * | 8/2011 | Lange | 254/409 |
| 8,002,244 | B2 * | 8/2011 | Curchod | 254/390 |

(Continued)

*Primary Examiner* — Emmanuel M Marcelo
*Assistant Examiner* — Michael Gallon
(74) *Attorney, Agent, or Firm* — Panitch Schwarze Belisario & Nadel LLP

(57) ABSTRACT

An equalizing rigging block for use with a synthetic roundsling is disclosed. The rigging block includes in preferred embodiments (a) a flatter and wider sheave to better accommodate a wider or flatter cross-section synthetic roundsling; (b) higher side sections for the sheave; and (c) a plurality of stacked bearings along the rigging block axis to provide enhanced lateral stability of the rigging block. In preferred embodiments, the rigging block sheave is manufactured from a synthetic material, such as plastic. The equalizing rigging block exhibits improved characteristics of holding a synthetic roundsling within the rigging block, and of reducing wear and tear on the roundsling.

9 Claims, 4 Drawing Sheets

(56) References Cited

U.S. PATENT DOCUMENTS

| | | | | |
|---|---|---|---|---|
| 8,322,765 | B2 | 12/2012 | St. Germain | |
| 8,733,739 | B2 * | 5/2014 | Mauthner et al. | 254/391 |
| 2004/0178398 | A1 * | 9/2004 | Miller et al. | 254/390 |
| 2008/0067482 | A1 * | 3/2008 | Carlson et al. | 254/397 |
| 2009/0074340 | A1 * | 3/2009 | Jimenez De Castro | 384/513 |
| 2009/0114893 | A1 * | 5/2009 | Lange | 254/390 |
| 2010/0032632 | A1 * | 2/2010 | Maire | 254/399 |
| 2010/0051887 | A1 * | 3/2010 | Wooster et al. | 254/217 |
| 2012/0018690 | A1 * | 1/2012 | Maire et al. | 254/413 |
| 2012/0228571 | A1 * | 9/2012 | Curchod | 254/416 |
| 2012/0292583 | A1 * | 11/2012 | Lob et al. | 254/390 |
| 2013/0319565 | A1 | 12/2013 | St. Germain, Jr. et al. | |
| 2014/0070154 | A1 * | 3/2014 | Win et al. | 254/416 |

* cited by examiner

EQUALIZING RIGGING BLOCK FOR USE WITH A SYNTHETIC ROUNDSLING

FIELD OF THE INVENTION

The invention generally relates to equalizing rigging blocks. More particularly, the disclosed invention relates to an equalizing rigging block for use with synthetic roundslings that may have a flatter cross-section than traditional rope slings. In a preferred embodiment, the inventive rigging block has a wider sheave and higher side sections on the sheave defining a channel within which the synthetic roundsling is maintained, and further has a plurality of stacked bearings along the sheave axis to provide enhanced lateral stability for the rigging block. In other preferred embodiments, various elements of the rigging block may be manufactured from synthetic materials such as plastic or composites. Having the sheave manufactured out of plastic reduces wear and tear on the synthetic roundsling as compared to a sheave manufactured from steel.

BACKGROUND OF THE INVENTION

In the field of lifting heavy loads, often times the load that is being lifted has a different shape. Such objects may not be readily lifted from a point that is close to the center-of-gravity ("CG") of the object. Indeed, the lifting point or points may not align with the load CG, which may tend to impart uneven loads to the object or the lifting crane.

To address this issue, when such loads are being lifted, the lifting ropes or slings need to be adjusted, or to adjust for the off CG lifting condition. Historically pulleys or roller rigging blocks have been used that allow for such load adjustment. Various pulleys and equalizer rope blocks have been known and used in the industry for many years. However, such prior art roller rigging blocks primarily have been and are used with wire or metal rope lifting apparatus.

Synthetic rope, and synthetic roundslings are becoming more prevalent in the lifting industry, especially for lifting of very heavy loads. Prior art rigging blocks, designed for use with wire rope, are not well suited to handle synthetic roungslings, which have different physical characteristics than wire rope. For example, many synthetic roundslings have a flatter or wider cross-section than a standard wire rope or cable.

Prior art rigging blocks, used with wire rope and wire cable, are not able to readily maintain such roundsling cross-sections in place in the rigging block, and could cause the wider cross-section roundsling to double over onto itself. There does not appear to be a rigging block, or equalizer rope block that is especially designed to handle the characteristics of a synthetic rope or synthetic roundsling when used in off center lifting operations. The current invention, as described below, teaches such an improved apparatus or equalizer rigging block for use with synthetic rope and synthetic roundslings.

SUMMARY OF THE INVENTION

The above noted problems, which are inadequately or incompletely resolved by the prior art are completely addressed and resolved by the present invention.

A preferred aspect of the present invention is a rigging block for use with synthetic roungslings, comprising a shackle having two legs; a sheave rotatably connected to the shackle along an axis between said shackle two legs, with said sheave having angled edges defining a channel within said sheave; and a plurality of bearings along said axis; wherein said channel of said sheave laterally holds said synthetic roundsling within said channel as the sheave rotates to equalize loads held by said roundsling.

Another more specific preferred embodiment of the present invention is a rigging block for use with synthetic roungslings, comprising a shackle having two legs; a sheave rotatably connected to the shackle along an axis between said shackle two legs, with said sheave having angled edges defining a channel within said sheave, said channel having a width of approximately six inches, said edges having a length of approximately three inches; and at least two bearings along said axis; wherein said channel of said sheave laterally holds said synthetic roundsling within said channel as the sheave rotates to equalize loads held by said roundsling.

BRIEF DESCRIPTION OF THE DRAWINGS

The invention is best understood from the following detailed description when read in connection with the accompanying drawings. It is emphasized that, according to common practice, the various features of the several drawings are not to scale, and the invention is not limited to the precise arrangement as may be shown in the accompanying drawings. On the contrary, the dimensions and locations of the various features are arbitrarily expanded or reduced for clarity, unless specifically noted in the attached claims.

DETAILED DESCRIPTION OF PREFERRED EMBODIMENTS

The present invention is an improved design for an equalizing rigging block used for lifting heavy loads with one or more synthetic roundslings. As noted above, equalizing rigging blocks for use with wire rope or cable have been known and used for many years. However, with the growth and expanded use of synthetic lifting rope and synthetic roundslings for lifting heavy loads, certain limitations and disadvantages of the prior art rigging blocks have become apparent. An improved equalizing rigging block, according to the present invention, to address the known limitations and disadvantages of prior art wire rope equalizing blocks, is disclosed and described herein.

Figure 1:
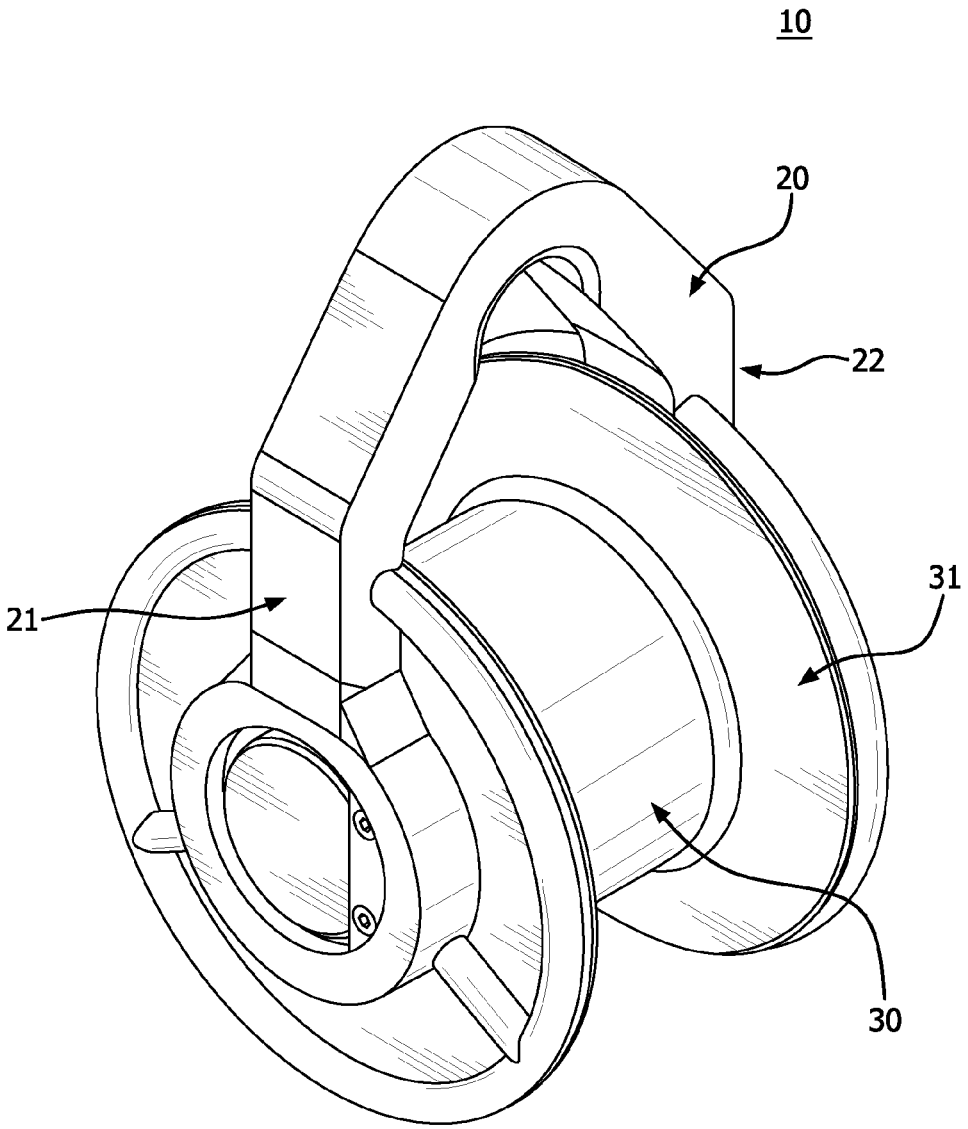
FIG. 1: is a isometric, perspective view of a preferred embodiment of the inventive equalizing rigging block.
Figure 2:
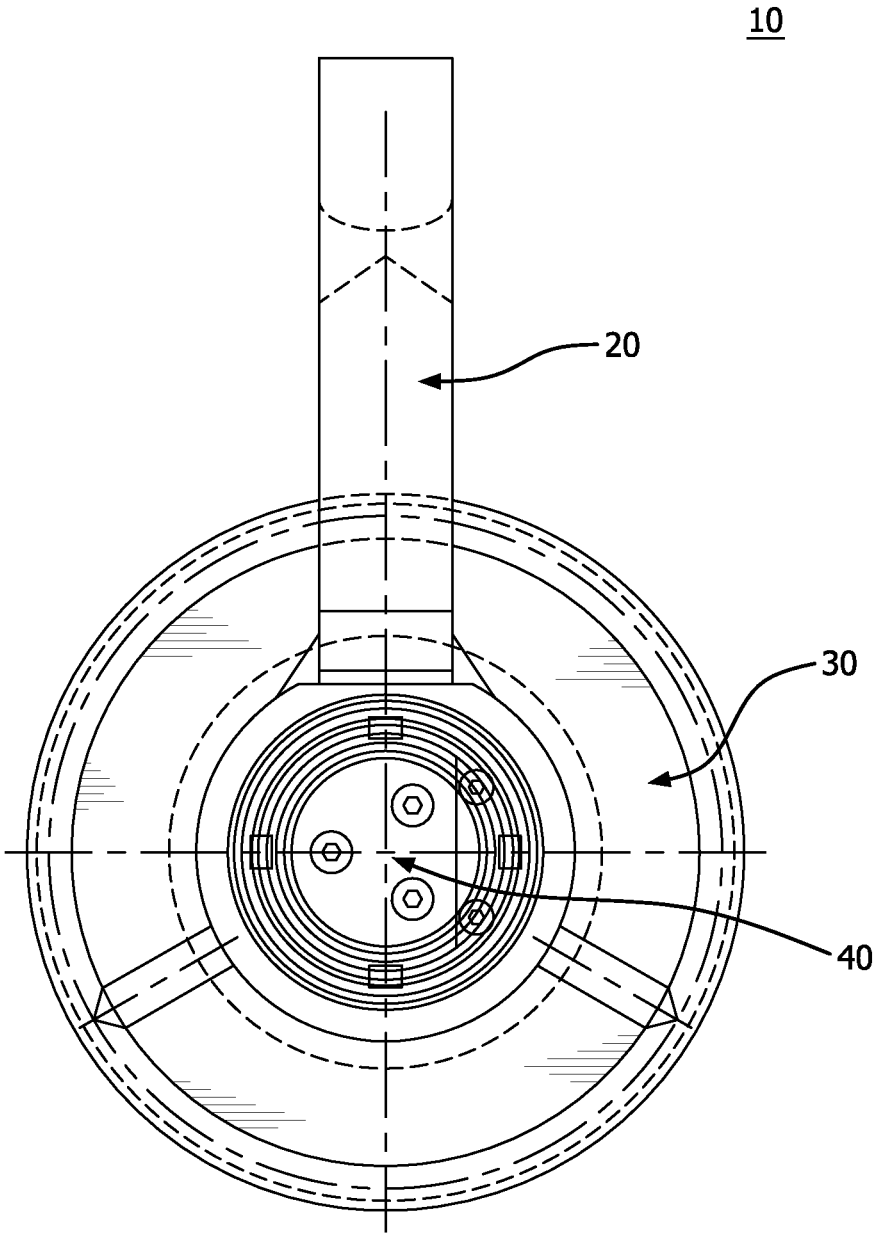
FIG. 2: is a side view of a preferred embodiment of the inventive equalizing rigging block.
Figure 3:
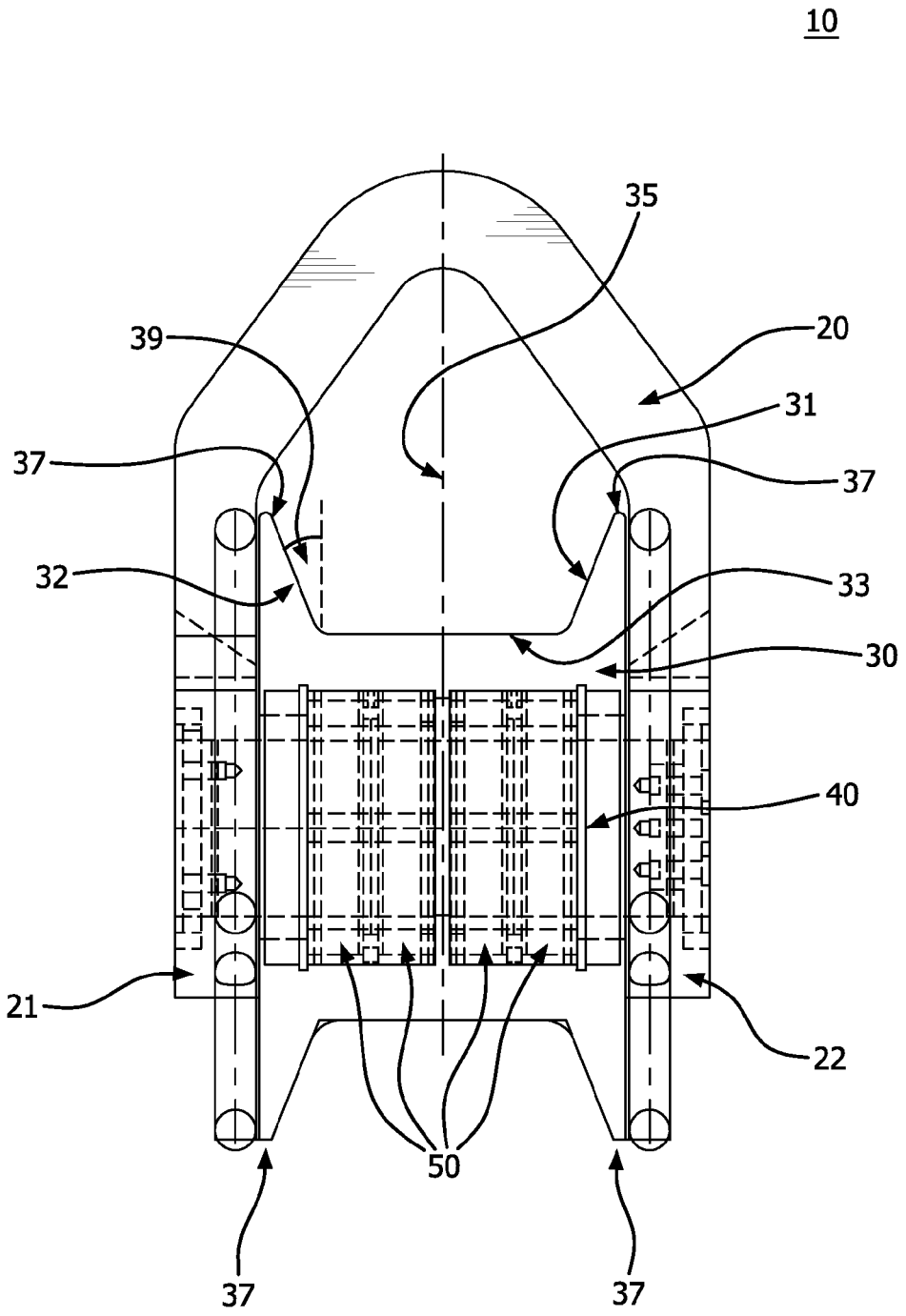
FIG. 3: is a front view of a preferred embodiment of the inventive equalizing rigging block.

More particularly, the equalizing rigging block according to the present invention has three primary elements: a shackle having two leg sections; a sheave rotatably connected to the shackle between the two legs along an axis, with the sheave having sides or edges; and a plurality of roller bearings located along the sheave rotation axis. As shown in FIGS. 1 through 3, a preferred embodiment of the inventive equalizing rigging block 10 includes a shackle 20 having two legs 21, 22. Located between the shackle legs is a sheave 30 that is fully rotatable along an axis 40 between the two shackle legs 21, 22. The shackle 20 shows the legs 21, 22 as being solid or unitary elements. In other preferred embodiments, the legs 21, 22 need not be unitary, but can be constructed to have openings or be constructed with multiple elements.

As shown in FIGS. 1 and 3, in a preferred embodiment, the sheave 30 has two important features. First, the sheave 30 has a wider center section 33, which may be substantially flat. Although the center section 33 is shown as being completely flat in the example embodiments in FIGS. 1 through 3, the center section 33 could also be constructed with a slight concave shape.

Figure 4:
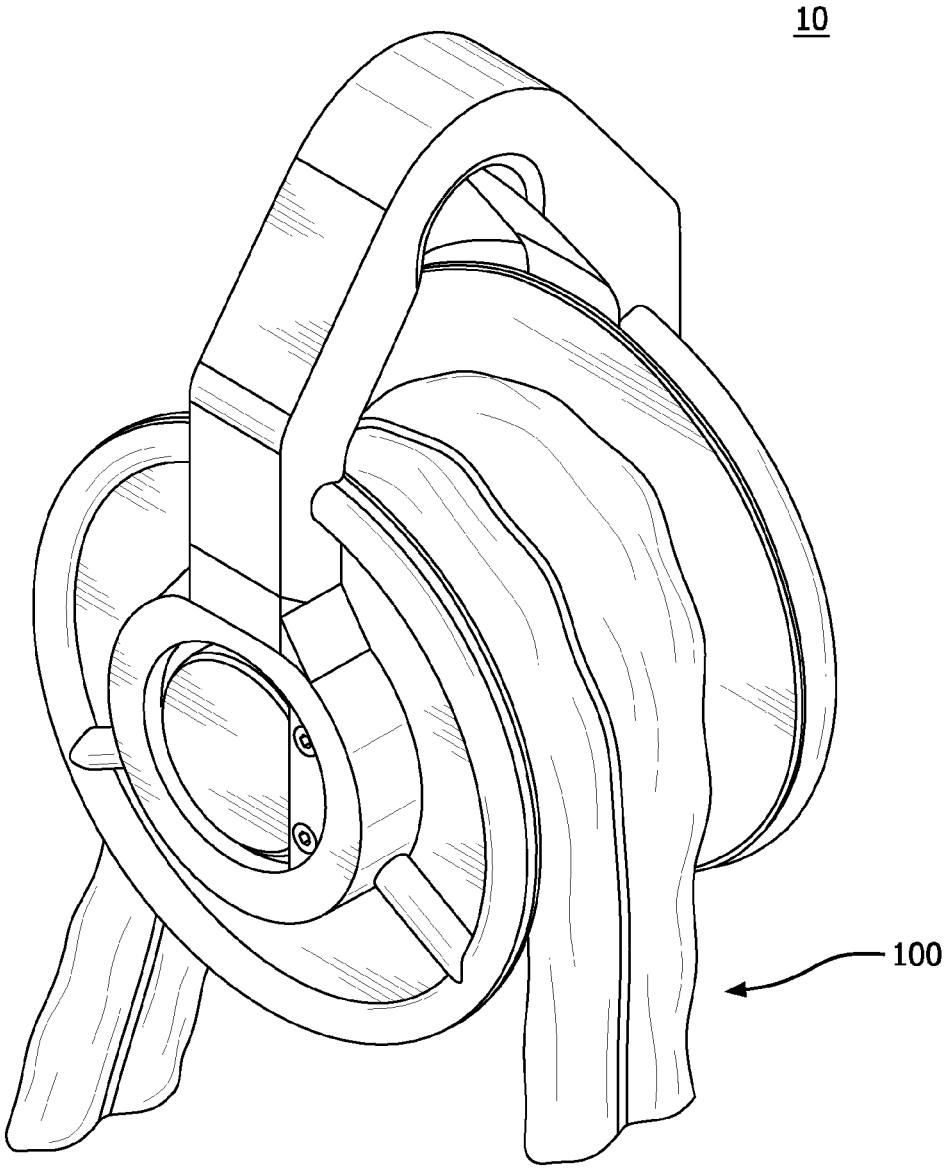
FIG. 4: is a perspective view of a preferred embodiment of the inventive equalizing rigging block with a synthetic roundsling (partially shown) in place.

On either end of the center section 33, are side walls 31, 32 that extend up from the substantially flat center section 33. The center section 33 and side walls 31, 32, as shown in FIG. 3, define a channel 35. The side walls 31, 32 provide a boundary on either side of the center section, and accordingly, a synthetic roundsling 100 is maintained within channel 35 as shown in FIG. 4 even as the sheave 30 may rotate to equalize loads between the two side of the rigging block 10.

The side walls, as shown in FIG. 3, may be at an angle 39 off of perpendicular to the center section 33. By incorporating an angle 39 for the side walls 31, 32, there is, as noted, lateral support for the roundsling 100. With such lateral support or boundaries, the roundsling will tend to be maintained within the channel 35 instead of riding up the side walls 31, 32, or doubling over onto itself. As noted, in a preferred embodiment, the center section 33 can be constructed with a slight concave shape, which would also assist to maintain the roundsling 100 within the channel 35.

While the side walls 31, 32 as shown in FIG. 3, are at an approximate angle of 30° off of a perpendicular to the center section 33, the angle at which the side walls 31, 32 are constructed can be within the approximate range of 20° to 70°, and be equally effective as a lateral boundary for the roundsling 100 and center section 33.

FIG. 3 shows a front view of a preferred embodiment of the inventive rigging block providing further detail of the sheave 30, sheave side walls 31, 32 and the channel 35 defined by the side walls 31, 32 and center section 33. By way of further description, also shown in FIG. 3 is the height of the side walls 31, 32, along with the rounded top edge 37 of both side walls 31, 32. The rounded top edge 37, is in close proximity to the edge of the shackle 20, thereby preventing the roundsling 100 from getting caught in, or bound in between the shackle 20 and the sheave 30 should the roundsling 100 walk up either of the side walls 31, 32.

Also shown in FIG. 3 are the plurality of bearings 50 located along axis 40. The bearings 50 are stacked in close proximity to each other and extend along a center section of axis 40. Such bearings 50 provide the necessary support for the sheave 30 to rotate along the axis and to equalize forces transmitted through the roundsling 100. Although the four bearings 50 shown in FIG. 3 are shown in direct proximity to each other, the bearings 50 may be "stacked" but still have some space or spacers in between each bearing 50. Moreover, the number of bearings 50 incorporated in the rigging block 10 may be determined by the needs of the lifting application or lifting operation. While the illustrated rigging block 10 shown in FIG. 3 has four stacked bearings, the number of bearings 50 can be any number such that the load requirements of the rigging block are met within the desired safety factor.

The inventive rigging block 10 components may be manufactured from different materials according to needs of the lifting operation. In a preferred embodiment, the sheave 30 may be manufactured from a synthetic material, such as plastic or a composite. Through use of plastic for the sheave 30, as compared to a sheave manufactured from steel, or another type of metal material, there will be less wear and tear on the synthetic roundsling 100. The synthetic cover often used with synthetic roundslings may worn or torn where the sheave surface is metal such as steel. A plastic sheave 30 will tend to be more forgiving to the synthetic cover of the roundsling.

Other components of the rigging block 10 may be constructed of non-synthetic materials. For example, in a preferred embodiment, the shackle 20 may be manufactured from steel to provide additional durability of the rigging block. However, it should be noted that as other components of the rigging block 10 are manufactured using steel, the weight of the rigging block will increase especially for larger size rigging blocks. By way of example, for a rigging block having component dimensions of approximately 15 inches for the sheave diameter, and approximately 13 inches for the width of the rigging block (from the edge of one shackle leg to the opposite edge of the other shackle leg), the weight of the rigging block using plastic for the sheave, is approximately 225 lbs.

The expected useable dimensions of the inventive rigging block are very broad. By way of example and not limitation, the channel width 33 can be constructed within the range of two to ten or more inches, and the edges or sides 31, 32 of the sheave can be constructed within the range of one to five inches. Such dimensions are easily able to accommodate a synthetic roundsling having a width of approximately four to six inches. However, synthetic roundslings having a flatter cross-section, have been constructed with widths in the range of approximately three to eight inches. For such synthetic roundslings, the sheave dimensions, and accordingly shackle dimensions may need to be revised to accept such different roundslings.

While particular embodiments of the inventive equalizing rigging block for use with synthetic roundslings have been described and illustrated, other similar rigging blocks which are readily understood to be equivalents of the inventive design are understood to be within the scope of this disclosure. For example, as noted, dimensions of the sheave 30, side walls, 31,32, sheave center section 33, may be varied according to the needs of the operation or lifting task. Moreover, the number or placement of the bearings 50 along the sheave axis 40 may be varied again according to the needs of the operation. All such variations are deemed to be within the scope of this invention and the attached claims.

What is claimed is:

1. A combination rigging block and synthetic roundsling, the combination comprising:

the rigging block comprising:

a shackle having two legs, the shackle constructed of a metal material;

a sheave rotatably connected to the shackle along an axis between said two legs, said sheave having a substantially flat center section and angled side walls extending outwardly from ends of the substantially flat center section, the substantially flat center section and the angled side walls defining a channel, the flat center section defining a channel width and a first angled side wall of the angled side walls defining a first length, the channel width being approximately two to ten inches and greater than the first length, each of the angled side walls having a rounded top edge opposite the ends of the substantially flat center section, the sheave having a diameter of approximately ten to twenty inches, the sheave constructed of a plastic material, the two legs including inner leg surfaces facing each other and the channel, the inner leg surfaces extending inwardly toward each other from inflection areas proximate the rounded top edges of the sheave to an apex spaced from the rounded top edges, the inner leg surfaces configured to extend inwardly proximate the top edges to limit the roundsling from getting caught in or bound in between the legs and the sheave; and a plurality of bearings along said axis; wherein said channel of said sheave is configured to laterally hold said synthetic roundsling within said channel such that the roundsling is in contact with at least the substantially flat center section as the sheave rotates to equalize loads held by said roundsling; and the synthetic roundsling having a synthetic cover, the plastic material of the sheave configured to limit wear and tear on the synthetic cover when the synthetic cover contacts and moves on the sheave, the roundsling having a roundsling width and a roundsling thickness, the roundsling width being greater than two times the roundsling thickness, the roundsling width being approximately equal to the channel width.

2. The combination rigging block and synthetic roundsling, as described in claim 1, wherein said sheave is manufactured from a composite material.

3. The combination rigging block and synthetic roundsling, as described in claim 1, wherein said sheave has a diameter of approximately fifteen inches.

4. The combination rigging block and synthetic roundsling, as described in claim 1, wherein the angled side walls both extend from the substantially flat center section at an acute angle, the acute angle being approximately within the range of 30 to 60 degrees.

5. The combination rigging block and synthetic roundsling, as described in claim 4, wherein the acute angle is approximately 45 degrees.

6. The combination rigging block and synthetic roundsling, as described in claim 1, wherein at least two bearings are stacked along said axis.

7. The combination rigging block and synthetic roundsling, as described in claim 1, wherein said channel width is approximately six inches.

8. The combination rigging block and synthetic roundsling, as described in claim 1, wherein the first length is approximately in the range of one to 5 inches.

9. The combination rigging block and synthetic roundsling, as described in claim 8, wherein the first length is approximately 3 inches.

* * * * *